252-99 AU 166 EX
5/24/83 US 4,384,970

United States Patent [19]
Tourdot et al.
[11] 4,384,970
[45] May 24, 1983

[54] STABILIZING COMPOSITIONS FOR PEROXIDE PRODUCTS

[75] Inventors: Jacques Tourdot, Paris; Henry Carron, Pantin, both of France

[73] Assignee: L'Air Liquide, Societe Anonyme pour l'Etude et l'Exploitation des Procedes Georges Claude, Paris, France

[21] Appl. No.: 316,052

[22] Filed: Oct. 28, 1981

[30] Foreign Application Priority Data

Nov. 4, 1980 [FR] France ..... 80 23524

[51] Int. Cl.³ ..... C11D 3/39; C11D 3/08; C11D 7/18; C11D 3/36

[52] U.S. Cl. ..... 252/99; 252/94; 252/95; 252/102

[58] Field of Search ..... 252/94, 95, 99, 102

[56] References Cited

U.S. PATENT DOCUMENTS

| | | | |
|---|---|---|---|
| 3,740,187 | 6/1973 | Kowalski | 252/99 |
| 3,766,078 | 10/1973 | Kowalski | 252/186 |
| 3,795,625 | 3/1974 | Kowalski | 252/186 |
| 3,860,391 | 1/1975 | Kling et al. | 252/186 |
| 4,225,452 | 9/1980 | Leigh | 252/102 |
| 4,279,769 | 7/1981 | Yagi et al. | 252/186 |

FOREIGN PATENT DOCUMENTS

| | | |
|---|---|---|
| 1420462 | 2/1966 | France . |
| 2140213 | 12/1973 | France . |
| 2396114 | 1/1979 | France . |

*Primary Examiner*—John E. Kittle
*Assistant Examiner*—Robert A. Wax
*Attorney, Agent, or Firm*—Browdy & Neimark

[57] ABSTRACT

Stabilizing compositions for peroxide products, which contain colloidal magnesium silicate associated with diethylenetriamine pentaacetic acid and diethylenetriaminepentamethylene phosphonic acid. These stabilizing compositions are intended particularly for use in home and industrial laundry powders.

6 Claims, No Drawings

STABILIZING COMPOSITIONS FOR PEROXIDE PRODUCTS

FIELD OF THE INVENTION

This invention relates to stabilizing compositions for peroxide products, especially when they are used in the bleaching and laundering of textile fibers and fabrics. These stabilizing compositions are intended particularly for use in home and industrial laundry powders.

BACKGROUND OF THE INVENTION

Most home laundry powders contain a peroxide compound, such as sodium perborate or sodium percarbonate, for improving the elimination of numerous stains and restoring the initial whiteness to the textile wash due to its laundering effect. Likewise, the textile industry generally uses baths containing a peroxide compound, such as hydrogen peroxide or sodium perborate, for the bleaching of unbleached textiles.

To obtain a maximum bleaching or laundering effect, it is necessary to effectively stabilize the peroxide compound. This stabilizing effect can be obtained by adding, to the washing bath, magnesium silicate which slows down the decomposition rate of the peroxide compound. The magnesium silicate makes it possible to retain the maximum active oxygen function in the bleaching bath above a temperature on the order of 60° C., due to which the peroxide compound attains its full effectiveness.

The magnesium silicate is added to the laundry powder either in the preformed state or is formed chemically "in situ" from the reaction of sodium silicate and a magnesium salt. The "in situ" formation process generally produces a rough feel in the laundered fabric, causes resistance to dyeing due to the lack of affinity of the fabric for water, and results in deposits to form in the bleaching or laundering machines which cause mechanical wear and weakening in the strength of the bleached textile fibers.

According to U.S. Pat. No. 3,860,391, assigned to Benkiser-Knapsak Company, a process of bleaching textile fibers in a bath without the use of a silicate has been proposed, in which bath the pH is adjusted to be between 9 and 12, and to which a stabilizing agent is added, the stabilizing agent consisting of a mixture of a hydroxyaliphatic compound containing 2 to 6 carbon atoms and a phosphonic acid chosen from the group consisting of an amino alkylene phosphonic acid, a hydroxyalkane phosphonic acid, a soluble salt of these acids and mixtures thereof; in these baths the peroxide compound is hydrogen peroxide.

The French Pat. No. 2,396,114, in the name of the company known as Manufacture de Produits Chimiques Protex, proposed various compositions intended to stabilize the hydrogen peroxide baths, an exemplary stabilizing composition, consisting, in a concentrated form, of stable and liquid formulations composed of sodium silicate and a magnesium complex, said magnesium complex being formed from phosphonic acids.

The French Pat. No. 2,420,593, in the name of Kao Soap, directed to bleaching compositions which do not alter the color of treated textiles, proposes to add, particularly to sodium percarbonate or to the additive product of tetrasodium 1,1,2,2-ethane tetracarboxylate and $H_2O_2$, at least one organophosphonic and organoacetic compound.

On the other hand, the French Pat. No. 2,140,213, in the name of Monsanto, relates to a stabilizing agent intended to reduce the decomposition of a peroxide compound contained in an aqueous alkaline solution. This agent is formed from a mixture of 1-hydroxyethylidene-1,1-diphosphonic acid (HEDP), a nitrilotriacetic acid (NTA), and water-soluble salts, such as magnesium sulfate.

The French Pat. No. 1,420,462, in the name of the applicants herein, relates to a process of stabilizing peroxide compounds by using magnesium silicate in the bleaching and laundering of textile fibers and fabrics, according to which the magnesium silicate is preformed in the colloidal state prior to such use. According to an exemplary method of practicing the process, the magnesium silicate, which is preformed in the colloidal state, is used in association with small quantities of a dimagnesium salt of ethylenediamine tetraacetic acid.

SUMMARY AND OBJECTS OF THE INVENTION

It has been found that in the presence of colloidal magnesium silicate, the association of an organoacetic sequestering agent in combination with an organophosphonic sequestering agent, both used in small quantity, has a synergistic effect on the stability of the bleaching or laundering bath; reduction of the degradation in the degree of polymerization of the textile fiber remains otherwise satisfactory.

This synergistic effect is especially pronounced when the bleaching or laundering bath contains traces of copper and iron.

According to the invention, stabilizing compositions having a colloidal magnesium silicate base are proposed for peroxide products, such as sodium perborate, sodium percarbonate, hydrogen peroxide etc., which are intended to stabilize laundering baths prepared with home laundry powders or bleaching baths used in the textile industry. These compositions contain a colloidal magnesium silicate associated with a slight amount of organoacetic type sequestering agent and also with a slight amount of organophosphonic type sequestering agent.

DETAILED DESCRIPTION OF THE PREFERRED EMBODIMENTS

Interesting results are obtained with a stabilizing composition containing 1 to 15% by weight of organophosphonic type sequestering agent and 1 to 20% by weight of organoacetic type sequestering agent; in particular amounts of 2 to 6% by weight of organophosphonic type sequestering agent and 1.5 to 8% by weight of organoacetic type sequestering agent are preferred.

The organophosphonic sequestering agent, in acid form or in water-soluble salt form, is a derivative of amino (lower alkane) phosphonic acids such as diethylenetriamine-pentamethylene phosphonic acid (DTPMP). The organoacetic sequestering agent is a derivative of amino (lower alkane) acetic acids such as diethylenetriamine pentaacetic acid (DTPA).

Tests have shown that there is a relation between the preservation, and indeed the improvement, of the degree of polymerization (DP) of a textile and the stabilization of a peroxide compound, characterized by the percentage of residual active oxygen in the laundering bath.

Comparative tests, conducted under identical conditions, have shown the superior effectiveness of the stabilizing compositions used according to the invention and the synergistic effect resulting from the new association with the above sequestering agents, compared with results obtained when colloidal magnesium silicate is used alone. The binary association of colloidal magnesium silicate with DTPA, on one hand, and DTPMP, on the other, is contrasted with the ternary association which proceeds according to the disclosure in French Pat. No. 2,140,213, as shown in the tabular data set forth below.

| | DP | Gain in DP |
|---|---|---|
| without stabilizer | 1000 | |
| magnesium silicate alone | 1040 | 40 |
| magnesium silicate + DTPA | 1180 | 180 |
| magnesium silicate + DTPMP | 980 | NONE |
| magnesium silicate + DTPA + DTPMP | 1300 | 300 |
| magnesium sulfate + NTA + HEDP | 920 | NONE |

It is thus found that the stabilizing composition, according to the invention, makes it possible to obtain a very substantial gain in the degree of polymerization, whereas the association proposed in the stabilizing composition of French Pat. No. 2,140,213 results in no improvement of the protection of the cellulose textile.

Moreover, it has been observed that the substitution of magnesium sulfate for magnesium silicate in association with the sequestering agents NTA+HEDP proposed in the above-referenced French Pat. No. 2,140,213, also constitutes an ineffective association with respect to the protection of the cellulose textile, which is to be laundered.

Some examples which illustrate the invention in a non-limiting manner are given below.

EXAMPLE 1

Composition having a colloidal magnesium silicate base were prepared with variable concentrations of DTPA and DTPMP. The concentrations of DTPA and DTPMP are given in percentage by weight of the pure product.

Table 1 below indicates the proportions by percent of the different compositions formulated.

TABLE 1

| Stabilizing Composition N° | DTPA % | DTPMP % |
|---|---|---|
| 1 | 0 | 0 |
| 2 | 7.5 | 0 |
| 3 | 20 | 0 |
| 4 | 0 | 4.8 |
| 5 | 0 | 10.7 |
| 6 | 7 | 4.4 |
| 7 | 6.6 | 10 |
| 8 | 19.2 | 3.8 |
| 9 | 18.2 | 8.8 |

Composition No. 1 includes neither DTPA nor DTPMP: it is a control composition which serves as a reference control composition to measure the effectiveness of the other compositions.

These stabilizing compositions have been tested in a laundry bath of the following formulation:

-continued

| | |
|---|---|
| (without peroxide): | 5 g/l |
| Sodium perborate tetrahydrate: | 3 g/l |
| Stabilizing composition: | 0.2 g/l |
| Fe (soluble salt): | 1.5 ppm |
| Cu (soluble salt): | 1.5 ppm |

The laundry bath is maintained at 90° C. for 1 hour, then the determination of the quantity of residual active oxygen (AO) is made with regard to the quantity of active oxygen initially contained in the bath.

The residual AO ratio in percent defines, in one way, the stabilizing power of the composition.

On the other hand, to demonstrate more effectively the advantages of the new composition, the gain in residual AO, produced by said compositions, is defined as the difference of the stabilizing power of one of these said compositions minus the stabilizing power of the control composition No. 1.

The gain in residual AO is expressed in percent, by the following formula:

$$\text{Gain in residual } AO\ \% = \text{Stabilizing power \% (stabilizing composition)} - \text{Stabilizing power \% (composition No. 1)}$$

EXAMPLE 2

Table 2 indicates the stabilizing power and the gain in residual AO of the different stabilizing compositions.

TABLE 2

| Stabilizing Composition N° | stabilizing power | Gain of AO |
|---|---|---|
| 1 (control) | 4% | |
| 2 | 24% | 20% |
| 3 | 43% | 39% |
| 4 | 15% | 11% |
| 5 | 57% | 53% |
| 6 | 57% | 53% |
| 7 | 75% | 71% |
| 8 | 57% | 53% |
| 9 | 82% | 78% |

The results set forth in Table 2 show that the stabilizing power and the gain in AO do not increase in direct proportion as a function of the increase of DTPA and DTPMP in the composition.

It is noted, for example, that compositions nos. 5, 6 and 8 have the same stabilizing power and the same gain in AO when the sum of the percentages of DTPA and DTPMP are 10.7%, 11.4% and 23% respectively.

EXAMPLE 3

The synergistic effect of the two sequestering agents is especially pronounced for composition No. 6; it is illustrated by the data set forth in Table 3

TABLE 3

| Composition N° | DTPA % | DTPMP % | Stabilizing power | Gain in AO |
|---|---|---|---|---|
| 2 | 7.5 | 0 | 24% | 20% |
| 4 | 0 | 4.8 | 15% | 11% |
| (2 + 4) ? | 7.5 | 4.8 | 39% | 31% |
| 6 | 7 | 4.4 | 57% | 53% |

Commerical laundry powder

Table 3 shows that the sum of the results of compositions Nos. 2 and 4, corresponding to the hypothetical composition (2+4)?, are clearly lower in stabilizing power and gain in AO than the results achieved in using composition No. 6 which actually contains slightly lower percentages of DTPA and DTPMP than the percentages of DTPA and DTPMP in the hypothetical composition "(2+4)?".

The synergy of DTPA and DTPMP, which are used in relatively small amounts, is particularly advantageous economically speaking because DTPMP is clearly more expensive than DTPA.

Composition No. 6 which contains only 4.4% of DTPMP has the same stabilizing power and the same gain in AO as composition No. 5, for example, which contains 10.7% of DTPMP.

EXAMPLE 4

If the degradation of the textile fiber during successive washings and more particularly the reduction of the degree of polymerization (DP) of the cellulose of the cotton are considered, such a clear synergistic effect is not found, but the results show, however, that the association of DTPA and DTPMP, in small amounts and in well-determined proportions, produced satisfactory results.

Tests relating to the reduction of the DP of the cellulose of the cotton were made according to the following test protocol:

Pieces of fabric were subjected to a series of 10 washings at 90° C. for 40 minutes in a Terg-o-tometer apparatus; the laundry bath therein had the following composition:

| | |
|---|---|
| commercial laundry powder (without peroxide): | 5 g/l |
| Sodium perborate tetrahydrate: | 3 g/l |
| Stabilizing composition: | 0.2 g/l |
| Fe (soluble salt): | 1.5 ppm |
| Cu (Soluble salt): | 1.5 ppm |

Thus, the stabilizing composition comprises on the order of 2.5% of the laundry composition.

The tested fabrics are of EMPA 301 fabric: it is a reference or control fabric (cotton) used in the textile laundry and bleaching industry; this fabric was supplied by the Laboratoire Federal d'Essais des Materiaux de l'Institute de Recherches de St. Gall (Federal Materials Testing Laboratory of the St. Gall Research Institute) in Switzerland.

On the other hand, the degree of polymerization of the cellulose is determined according to the method described in the AFNOR standard T 12005. The DP of the EMPA 301 fabric was 1850 at the start, before the washings.

The results of this experiment are given in Table 4.

TABLE 4

| Composition N° | D.P. after 10 washings | Residual DP in % |
|---|---|---|
| without stabilizer | 670 | 36.2 |
| 1 | 700 | 37.8 |
| 2 | 960 | 52.0 |
| 3 | 1010 | 54.6 |
| 4 | 800 | 43.2 |
| 5 | 1120 | 60.5 |

TABLE 4-continued

| Composition N° | D.P. after 10 washings | Residual DP in % |
|---|---|---|
| 6 | 1140 | 61.6 |
| 7 | 1350 | 73.0 |
| 8 | 1180 | 63.8 |
| 9 | 1360 | 73.5 |

The results set forth in table 4 show that the residual DP generally depends on the overall quantity of DTPA and DTPMP sequestering agent present in the stabilizer composition. DTPMP has a more pronounced effect on maintenance of the DP than DTPA.

The synergistic effect is less pronounced although use of composition No. 6, for example, results in a residual DP of 61.6% which is clearly higher than the residual DP achieved by use of composition No. 2 (52%) and composition No. 4 (43.2%).

EXAMPLE 5

An effort has been made to compare the effectiveness of various stabilizing compositions for peroxide products, especially when they are used in the bleaching and laundering of textile fibers and fabrics.

According to example 5, table 3 (6), of the French Pat. No. 2,140,213, a stabilizing solution of 36.1% of 1 mole of NTA, 0.47 mole of magnesium (resulting from a soluble salt of magnesium sulfate) and 0.3 mole of HEDP are used. Alternatively, a solution which contains by weight 29% of 90% NTA, 15.8% of $MgSO_4$, 7 $H_2O$ and 14.1% of 60% HEDP may be used.

According to this invention, the stabilizing composition is made up of 78% colloidal magnesium silicate, 14.5% DTPA in 40% solution (sodium salt) and 7.5% DTPMP in 50% solution.

To verify the effectiveness of the different stabilizing compositions, a series of washings of EMPA 301 fabrics were made in the presence of iron and copper.

In a "Terg-O-tometer" apparatus, pieces of the fabric were subjected to a series of washings at 90° C., for 40 minutes, including the time necessary for the rise in temperature to the operating range (approximately 30 minutes), in a laundry bath of the following composition:

| | |
|---|---|
| Quality of the water: | distilled water |
| Commerical laundry powder without peroxide: | 5 g/l |
| Sodium perborate tetrahydrate: | 3 g/l |
| Iron (iron sulfate): | 1.5 ppm |
| Copper (copper sulfate): | 1.5 ppm |
| Fabric: | 28 g per 1 liter of bath |

The degradation of the cellulose was evaluated by determining the degree of polymerization DP after a series of 5 washings in the presence of each stabilizing composition.

The example cited in French Pat. No. 2,140,213 takes into account a concentration of 2 g/l of stabilizing composition in a bath containing 22 g of 35% $H_2O_2$ per liter.

Only 0.2 g/l of the said stabilizing composition was used compared to the same quantity for this invention because of a much lower content of active oxygen, namely 300 mg/l instead of 3600 mg/l in the prior art composition.

The results obtained are recorded in Table 5.

TABLE 5

| | C Composition | | | | | | | |
|---|---|---|---|---|---|---|---|---|
| Test N° | Silicate mg mg/l | DTPA 40% mg/l | DTPMP 50% mg/l | NTA 90% mg/l | HEDP 60% mg/l | $MgSO_4$ $7H_2O$ mg/l | Residual AO % | DP |
| 1 | — | — | — | — | — | — | 0 | 1000 |
| 2 | 200 | — | — | — | — | — | 0 | 1040 |
| 3 | 200 | 37.5 | — | — | — | — | 35 | 1180 |
| 4 | 200 | — | 19 | — | — | — | 8 | 980 |
| 5 | 200 | 37.5 | 19 | — | — | — | 45 | 1300 |
| 6 | 200 | — | — | 17 | — | — | 11 | 990 |
| 7 | 200 | — | — | — | 16 | — | 1 | 1040 |
| 8 | 200 | — | — | 17 | 16 | — | 5 | 1010 |
| 9 | 200 | — | 19 | 17 | — | — | 26 | 1110 |
| 10 | 200 | 37.5 | — | — | 16 | — | 33 | 1140 |
| 11 | — | — | — | 58 | 28 | 32 | 10 | 920 |

DP = degree of polymerization; AO % residual active oxygen

A reading of the results appearing in this table demonstrates the synergistic effect of the use of the composition of test no. 5, according to the invention: colloidal magnesium silicate+DTPA+DTPMP, whereas no improvement in the protection of the cellulose is obtained in tests nos. 8 and 11: relative to the associations colloidal magnesium silicate+NTA+HEDP and magnesium sulfate+NTA+HEDP, respectively in the stabilizing composition.

Moreover, it is found that in Test condition 5, the sodium perborate is more effectively stabilized than in the other tests. In test 5, the quantity of residual active oxygen is 45%, whereas it is only 5 and 10% in tests nos. 8 and 11.

What is claimed is:

1. A stabilizing composition having a colloidal magnesium silicate base, for use in combination with peroxide compositions in bleaching or whitening baths for the protection of cellulose fibers treated in said baths, wherein the stabilizing composition contains colloidal magnesium silicate in combination with small amounts of diethylenetriamine pentaacetic acid and diethylenetriaminepentamethylene phosphonic acid.

2. Stabilizing composition according to claim 1, wherein the diethylenetriamine pentaacetic acid is present in the combination, in a concentration of 1 to 20% by weight, and the diethylenetriaminepentamethylene phosphonic acid in a concentration of 1 to 15% by weight.

3. Stabilizing composition according to claim 1, wherein the composition contains 1.5 to 8% by weight of diethylenetriamine pentaacetic acid and 2 to 6% by weight of diethylenetriaminepentamethylene phosphonic acid.

4. Laundry powder composition containing the stabilizing composition of any one of claims 1 to 3 together with a peroxide compound and a laundering compound.

5. Laundry powder composition according to claim 4 wherein the stabilizing composition comprises on the order of about 2.5% of the laundry powder composition.

6. Laundry powder composition according to claim 4 further containing a trace amount of copper salt and iron salt.

* * * * *